US007487656B2

(12) United States Patent
Hodjat

(10) Patent No.: US 7,487,656 B2
(45) Date of Patent: Feb. 10, 2009

(54) METHOD OF SPINNING MULTIPLE PARTS

(75) Inventor: Yahya Hodjat, Oxford, MI (US)

(73) Assignee: The Gates Corporation, Denver, CO (US)

( * ) Notice: Subject to any disclaimer, the term of this patent is extended or adjusted under 35 U.S.C. 154(b) by 118 days.

(21) Appl. No.: 11/731,213

(22) Filed: Mar. 30, 2007

(65) Prior Publication Data

US 2008/0236232 A1 Oct. 2, 2008

(51) Int. Cl.
*B21D 22/14* (2006.01)

(52) U.S. Cl. ..... 72/82; 72/80; 72/125

(58) Field of Classification Search ..... 72/80, 72/82, 83, 84, 85, 120, 121, 125, 344
See application file for complete search history.

(56) References Cited

U.S. PATENT DOCUMENTS

| | | | | |
|---|---|---|---|---|
| 2,243,522 | A * | 5/1941 | Conklin | 29/425 |
| 3,788,114 | A * | 1/1974 | Marcovitch | 72/83 |
| 3,908,421 | A | 9/1975 | Killian et al. | 72/82 |
| 4,050,274 | A * | 9/1977 | Doi | 72/82 |
| 4,055,976 | A | 11/1977 | Kraft | 72/83 |
| 4,669,291 | A | 6/1987 | Asari et al. | 72/83 |
| 5,323,630 | A * | 6/1994 | Wenzel et al. | 72/83 |
| 6,253,589 | B1 * | 7/2001 | Putz et al. | 72/85 |

FOREIGN PATENT DOCUMENTS

DE 100 50 202 A1 4/2002

OTHER PUBLICATIONS

Notification of Transmittal of the International Search Report and the Written Opinion of the International Searching Authority, or the Declaration for International Application No. PCT/US2008/001561 Mailed Jun. 10, 2008.

* cited by examiner

*Primary Examiner*—Edward Tolan
(74) *Attorney, Agent, or Firm*—Jeffrey Thurnau, Esq.; Jerry Mahurin, Esq.; Paul Dunlap, Esq.

(57) ABSTRACT

A method of spinning multiple parts comprising attaching two blanks to an intermediate mandrel, loading the intermediate mandrel and blanks into the spinning machine by clamping the intermediate mandrel and the blanks between the spinning machine tailstock and the headstock, moving rollers simultaneously radially inward and outward to execute metal forming on each blank to form a part from each blank, ejecting the intermediate mandrel, and ejecting each part substantially simultaneously from the intermediate mandrel.

6 Claims, 6 Drawing Sheets

METHOD OF SPINNING MULTIPLE PARTS

FIELD OF THE INVENTION

The invention relates to a method of simultaneously spinning two parts using an intermediate mandrel in a spinning machine.

BACKGROUND OF THE INVENTION

Spinning is a manufacturing process where a part is formed by being subjected to the forming stresses applied by a roller (or rollers) many times. Each element of metal is brought into the material's plastic region for a very short period of time and formed. The process repeats as many times as required. The ability to form the part an almost limitless number of times gives spinning a great advantage over other processes such as press forming. Some parts can only be practically made by a spinning process in order to be technically and commercially acceptable.

A state of the art for spinning pulleys is known as the split metal process, where the edge of a round metal blank is formed into the pulley sheaves. Spinning pulleys requires high clamping forces on a blank between a headstock and a tailstock tooling. The clamping force for automotive type pulleys is between 40 to 60 metric tons. The clamped part rotates at 400 to 1000 rpm. As it rotates it is exposed to side loads from forming rolls with pressures in the range of about 10 to 15 metric tons each. For typical automotive pulleys there is usually a need to use four rolls. This results in a very heavy and costly equipment as high clamping force and side loads are imposed upon rotating bearings. Hence, the state of the technology today is to make only one part at a time.

Representative of the art is U.S. Pat. No. 4,669,291 which discloses an improved multiple roller spinning machine for spinning vehicle one-piece wheels is disclosed in which the roller holder is capable of sliding in a direction parallel with the axis of spinning and has a hydraulic cylinder which moves through its axially movable piston rod the holder horizontally thereby bringing the multiple rollers sequentially in to an operating position just above the wheel material clamped between the dies of the driving and driven spindles. Each of the multiple rollers is coupled to a control hydraulic cylinder which drives through its piston the respective roller vertically between a retracted position and a drawing position where the roller is pressed against the periphery of the wheel material. Thus, not only can the sequence of different drawing steps, in a most preferable embodiment, from rough to finishing drawing, be completed in an automatic continued manner, but also operation of the hydraulic cylinder to shift the holder, with the particular roller pressed against the material periphery being set in spinning, causes the roller to draw a wider range than its size across the U-cross section portion of the periphery. According to another embodiment, the holder carries therein multiple rows of different forming rollers arranged radially about a common center such that the wheel material can be subject to drawing by multiple rollers simultaneously applied at different points about the material periphery.

What is needed is a method of simultaneously spinning two parts using an intermediate mandrel in a spinning machine. The present invention meets this need.

SUMMARY OF THE INVENTION

The primary aspect of the invention is to provide a method of simultaneously spinning two parts using an intermediate mandrel in a spinning machine.

Other aspects of the invention will be pointed out or made obvious by the following description of the invention and the accompanying drawings.

The invention comprises a method of spinning multiple parts comprising attaching two blanks to an intermediate mandrel, loading the intermediate mandrel and blanks into the spinning machine by clamping the intermediate mandrel and the blanks between the spinning machine tailstock and the headstock, moving rollers simultaneously radially inward and outward to execute metal forming on each blank to form a part from each blank, ejecting the intermediate mandrel, and ejecting each part substantially simultaneously from the intermediate mandrel.

BRIEF DESCRIPTION OF THE DRAWINGS

The accompanying drawings, which are incorporated in and form a part of the specification, illustrate preferred embodiments of the present invention, and together with a description, serve to explain the principles of the invention.

DETAILED DESCRIPTION OF THE PREFERRED EMBODIMENT

Figure 1:
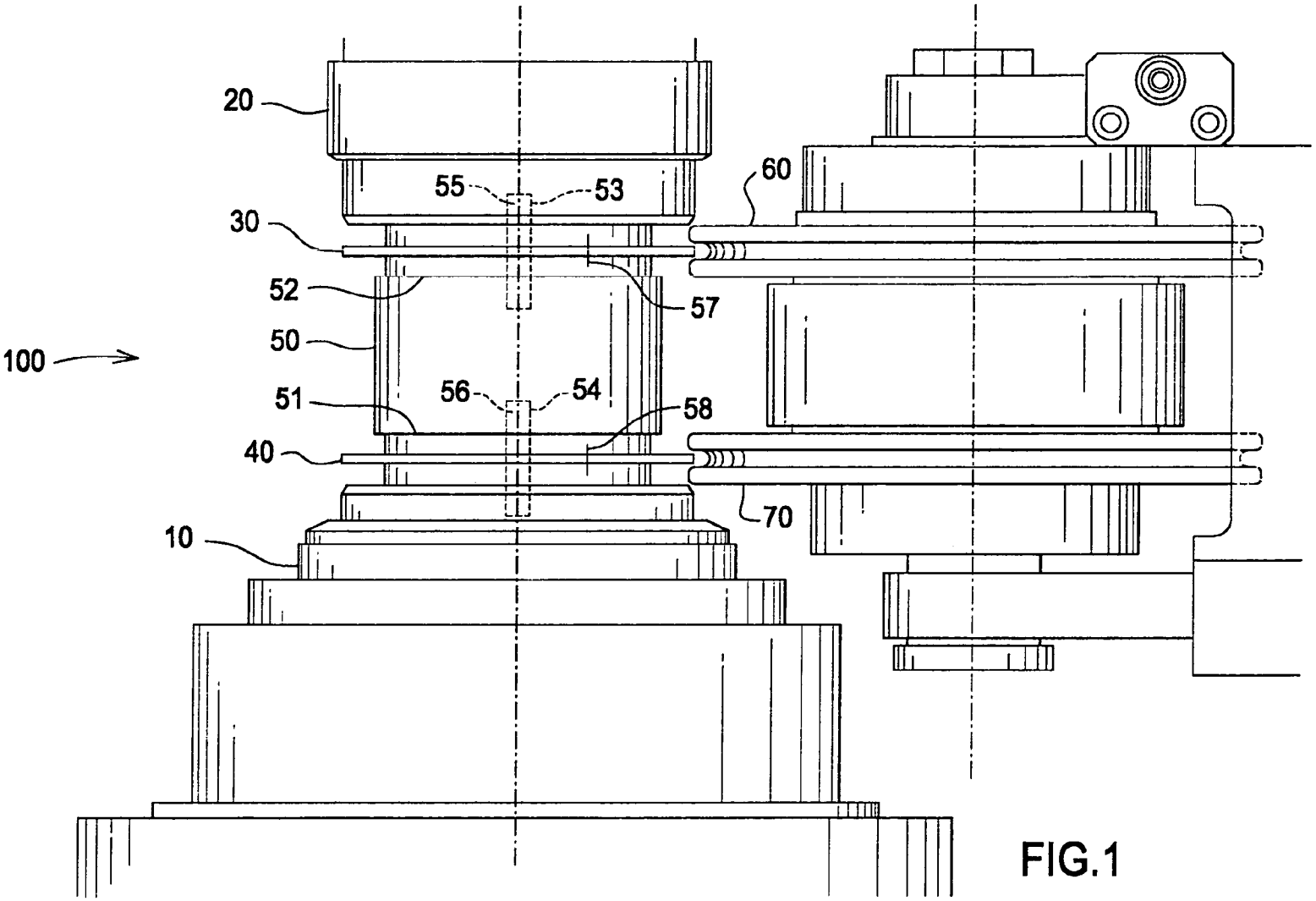
FIG. 1 is a side view of the spinning apparatus.

FIG. 1 is a side view of the spinning apparatus. The inventive method comprises a new process and tooling where two or more parts are spun simultaneously.

Referring to FIG. 1, a headstock 10 and tailstock 20 tooling are the same as those known in the art. However, in between them, rather than putting one blank at a time between them as per the prior art, instead, two or more blanks 30, 40 are placed. An intermediate mandrel 50 is placed between each set or pair of blanks 30, 40.

Following is a description of the process and method for two part spinning, for example, a pulley. Multi part spinning is an alternate embodiment of the this process by simply increasing the number of blanks and intermediate mandrels as required.

First, an intermediate mandrel 50 is used such that on the side 51 facing the headstock 10 it has the shape of the tailstock 20 and on the side 52 facing the tailstock 20 it has the shape of the headstock 10. Intermediate mandrel 50 has the least possible length to optimize the number of parts that can be spun at the same time and to reduce deflection of the tooling under forming side forces.

For efficiency and optimization of equipment utilization and pre-staging purposes, more than one set of intermediate mandrels are utilized.

Next, pre-formed blanks 30, 40 are attached to upper 52 and lower 51 portions of the intermediate mandrel 50 by mechanical (e.g. suction) or magnetic or other suitable means.

The intermediate mandrel comprises center hole 53, 54 and cooperating center posts 55, 56 and pins 57, 58 that locate the blank 30, 40 on the intermediate mandrel 50 and locate the intermediate mandrel on the tooling in the machine.

The intermediate mandrel 50 and pre-form blanks 30, 40 attached to it are then loaded in the spinning machine 100. Tailstock 20 moves down to clamp the intermediate mandrel 50 using the cooperating pins, holes, and posts with high clearance and conical shapes at the guiding ends and for a tight locating clearance as the tailstock closes under pressure.

Figure 2:
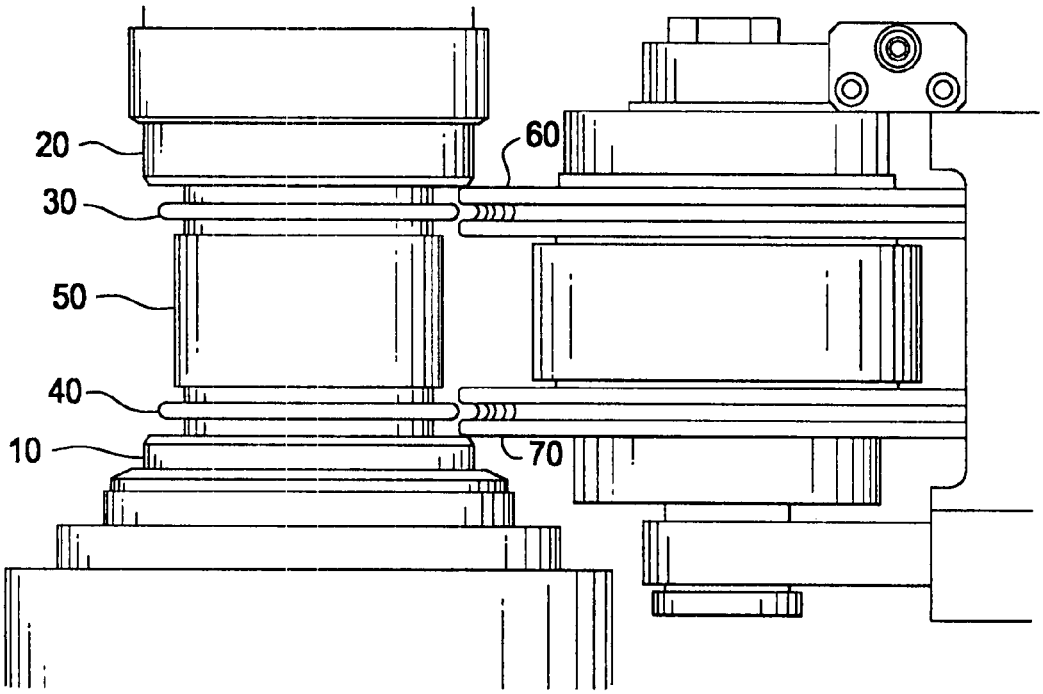
FIG. 2 is a side view of the rollers adjacent the blanks.

Rollers 60, 70 move radially inward and outward to execute a number of metal forming steps until the pulley or other part is finished. FIG. 2 is a side view of the rollers adjacent the blanks. As is known in the art rollers 60, 70 each have a profile suited to each rolling step. The rollers as shown roll each blank's material radially inward thereby thickening and expanding the edge of the blank along the spinning axis.

Figure 3:
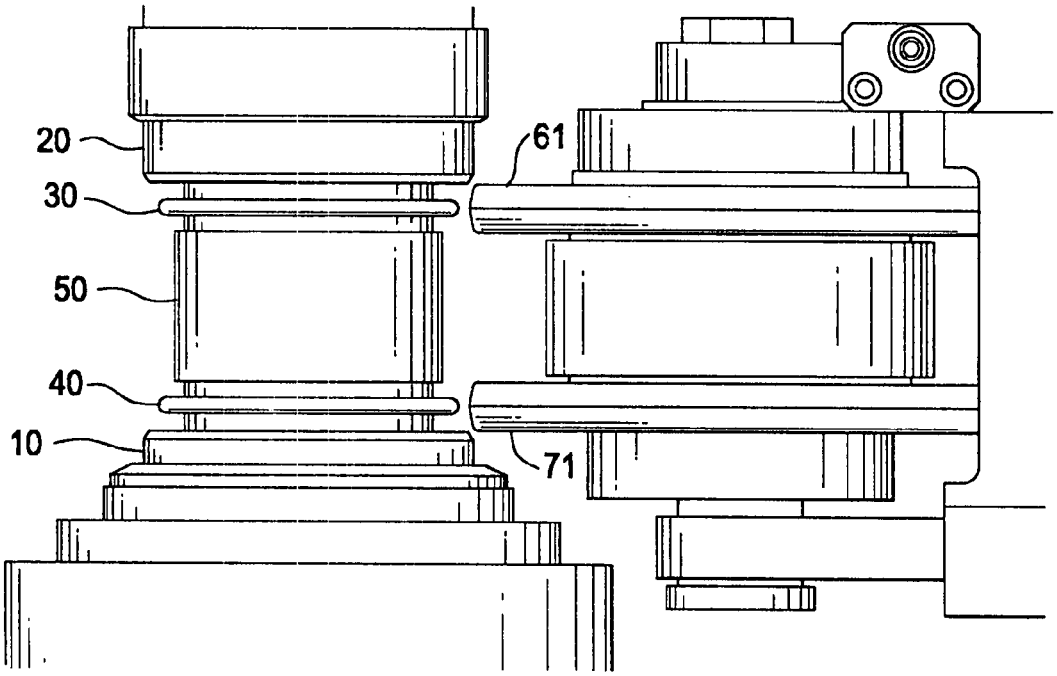
FIG. 3 is a side view of the rollers adjacent the blanks.
Figure 4:
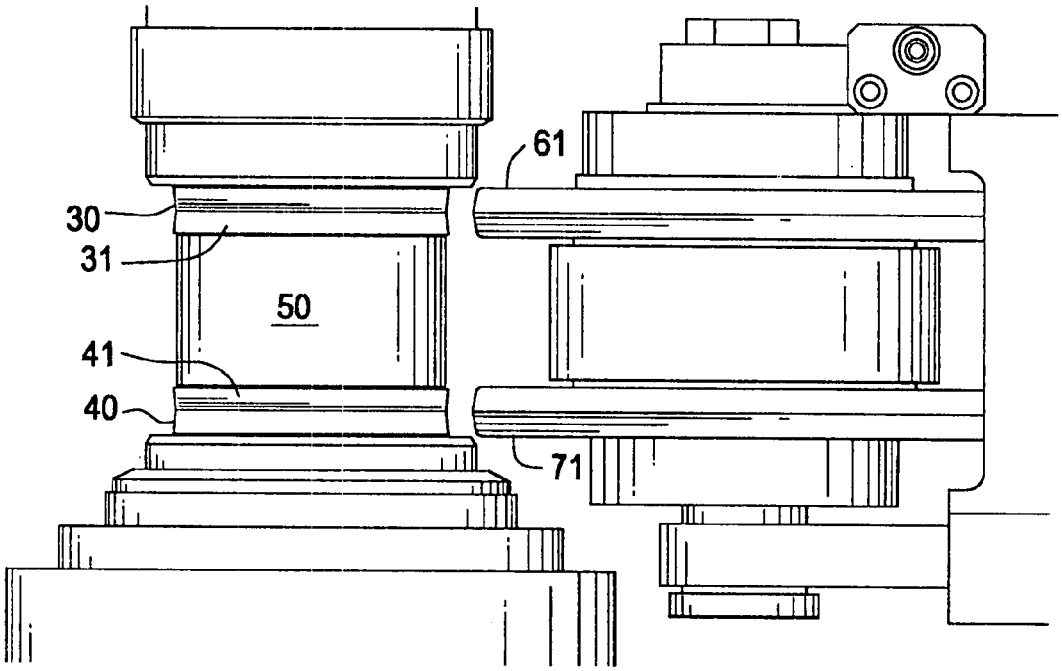
FIG. 4 is a side view of the rollers adjacent the blanks.

FIG. 3 is a side view of the rollers adjacent the blanks. Rollers 61, 71 flatten and further expand the edge of each blank 30, 40, FIG. 4 is a side view of the rollers adjacent the blanks. Rollers 61, 71 have flattened the surface 31, 41 of each blank.

Figure 5:
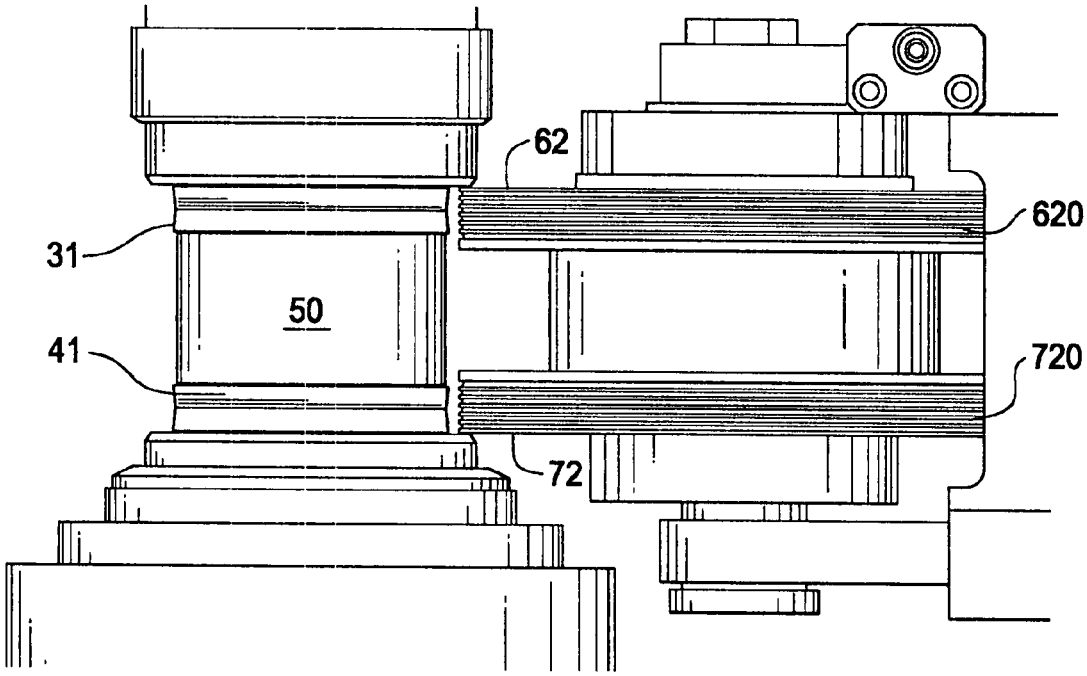
FIG. 5 is a side view of the rollers adjacent the blanks.

FIG. 5 is a side view of the rollers adjacent the blanks. Rollers 62, 72 each have a surface 620, 720 configured to spin a multi ribbed profile onto surfaces 31, 41. A multi-ribbed profile is used on pulleys for engaging multi-ribbed belts. Surfaces of rollers 620, 720 need not be similar and can be different allowing production of pulleys having different surfaces profiles, such as differences in the number of ribs.

Figure 6:
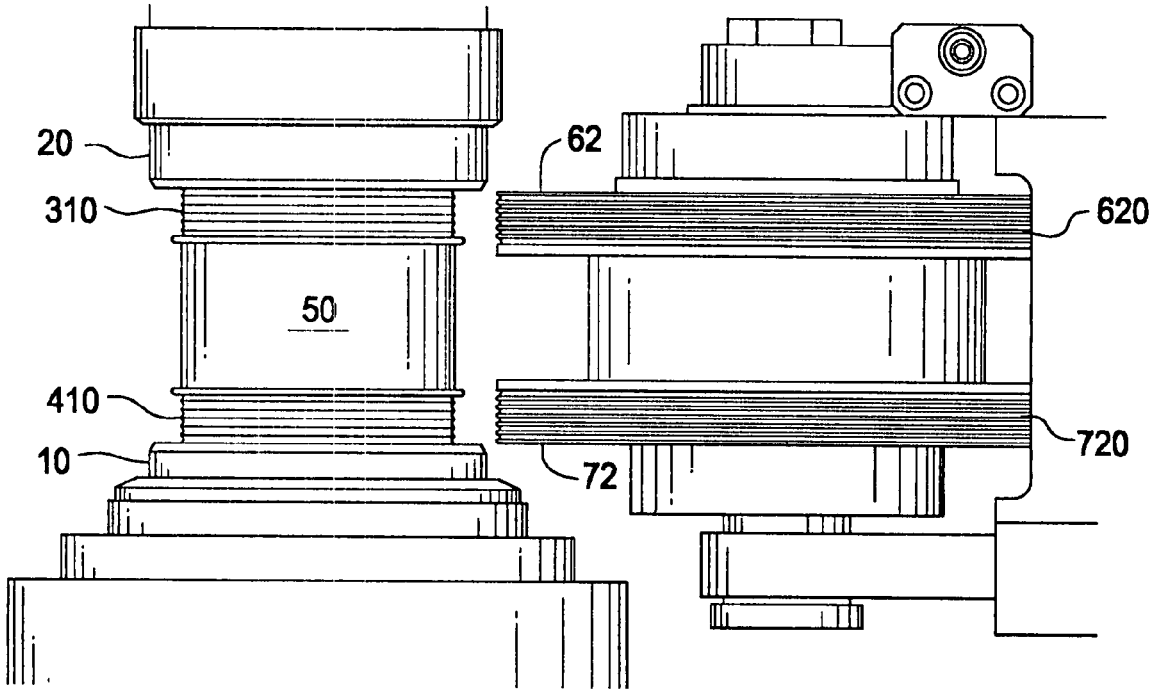
FIG. 6 is a side view of the blanks with the multi-ribbed profile applied.

FIG. 6 is a side view of the blanks with the multi-ribbed profile applied. Blanks 30, 40 now have multi-ribbed surfaces 310, 410 respectively.

Once the spinning process is complete through the step in FIG. 6, tailstock 20 retracts axially and the finished parts with intermediate mandrel 50 are ejected. Since the pulleys are formed by cold flow forming, the side forming forces (radially applied forces when compared to the axis of rotation) required are high (~12+ tons per part). Therefore, after spinning the parts can stick to the intermediate mandrel and may need to be removed by force. As is known in the art, hydraulic ejectors in the headstock 10 and tailstock 20 routinely force a finished part out using between 5 and 10 tons of force.

Figure 7:
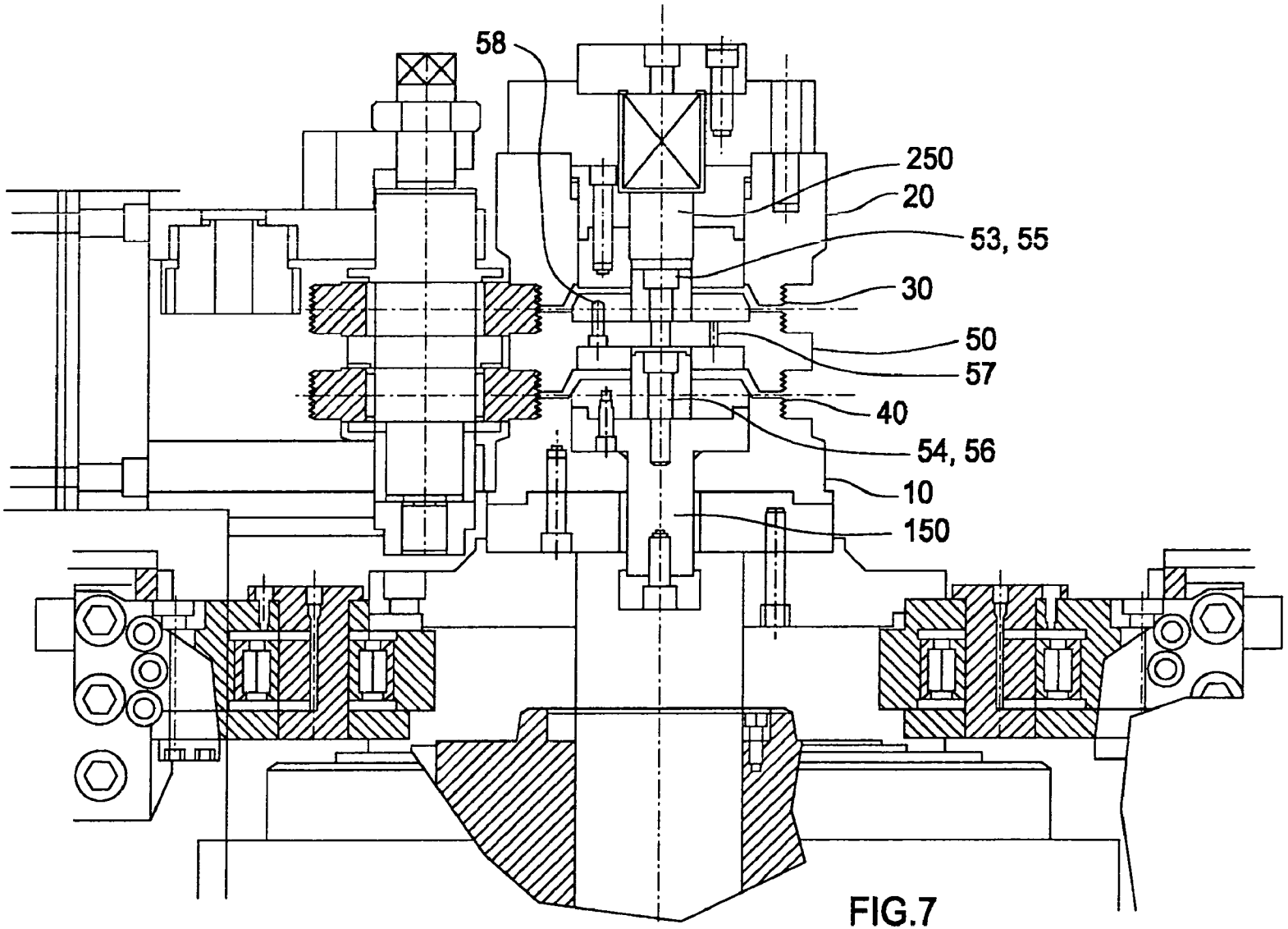
FIG. 7 is a cross sectional view of the spinning machine.

In the inventive process, to simplify the loading-unloading of parts a selective ejection is performed. Namely, both headstock 10 and tailstock 20 ejectors are used to kick or push the finished part off of the tooling portions that are attached to the machine. Ejectors 150 and 250 are shown in FIG. 7. FIG. 7 is a cross sectional view of the spinning machine. Consequently both parts remain stuck to the middle intermediate mandrel 50. Immediately after removal, a new mandrel with two or more blanks is loaded back into the spinning machine.

Figure 8A:
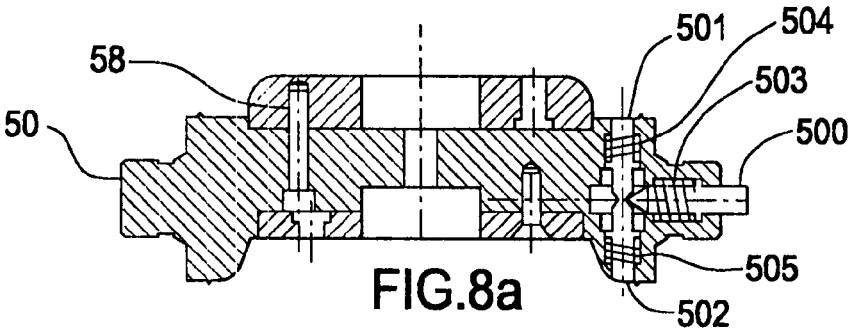
FIG. 8 is a cross sectional view of the intermediate mandrel.
Figure 8B:
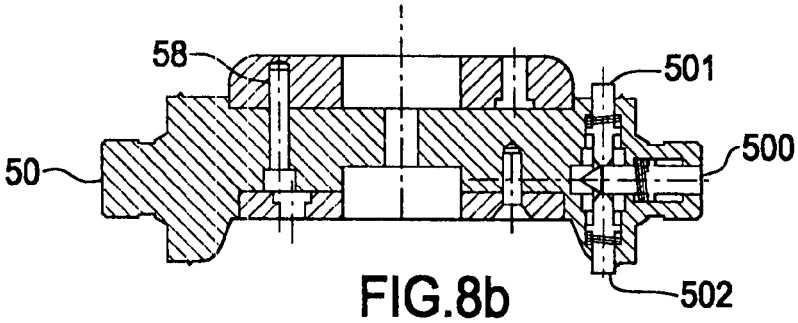

FIG. 8 is a cross sectional view of the intermediate mandrel. Referring to FIG. 8(*a*) intermediate mandrel 50 comprises plunger 500 which is cooperatively engaged with ejector member 501 and ejector member 502. When plunger 500 is pressed radially inward it forces ejector members 501 and 502 to move axially thereby ejecting the completed parts (not shown) from the intermediate mandrel. Referring to FIG. 8(*b*), plunger 500 is shown pressed radially inward and ejector members 501 and 502 are extended axially outward thereby ejecting completed parts (not shown).

Plunger 500 and ejector members 501, 502 are biased in the retracted position using springs 503, 504, and 505.

Figure 9:
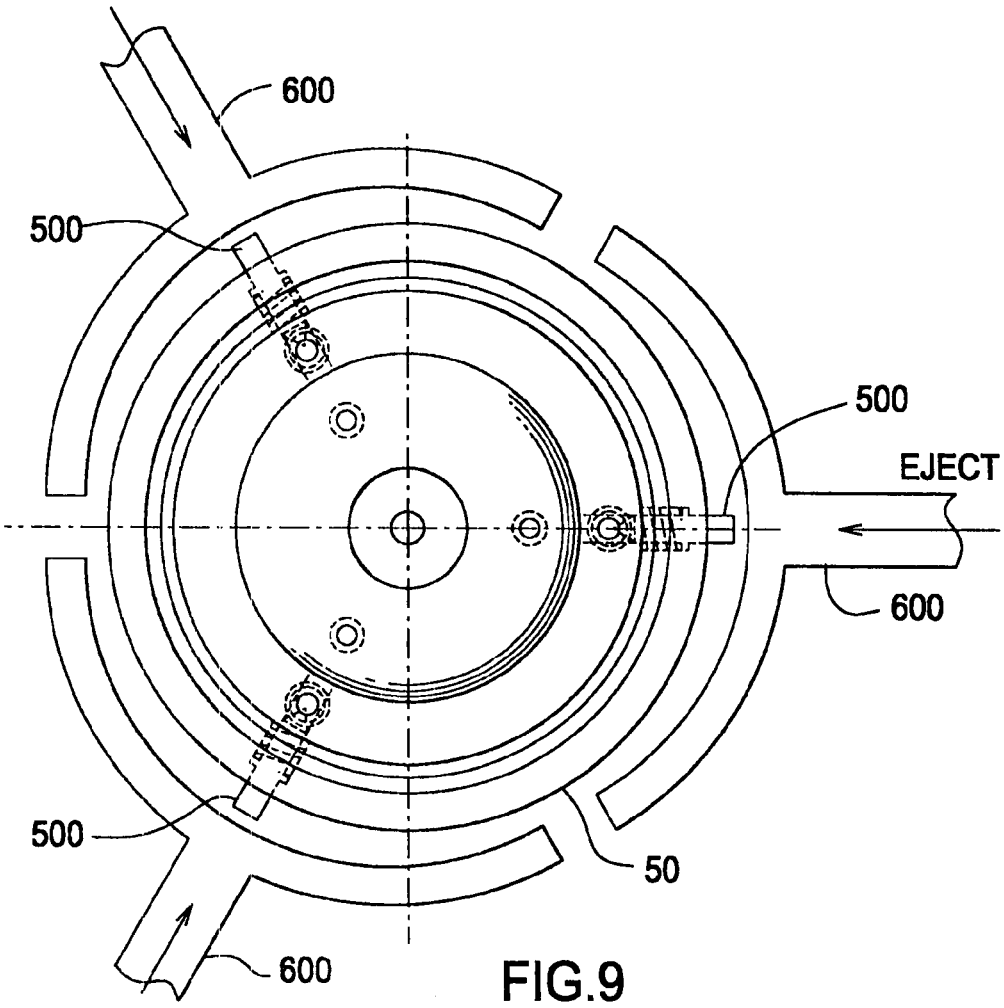
FIG. 9 is a plan view of the intermediate mandrel part ejection method.

FIG. 9 is a plan view of the intermediate mandrel part ejection method. Once the intermediate mandrel with parts attached is removed from the spinning machine, the finished parts are separated from the intermediate mandrel by a simple actuator, mechanical or pneumatic forces. For example, ejectors 600 simultaneously press upon plungers 500 to eject the completed parts.

Ejection of the completed parts can occur while the intermediate mandrel is within the spinning machine and the completed parts are ejected and new blanks are loaded.

In the alternative, the intermediate mandrel is removed from the spinning machine so the completed parts can be ejected in a separate step. During that time another intermediate mandrel that has already been reloaded with new blanks is immediately inserted into the spinning machine, thereby speeding the manufacturing process. Namely, an alternate method comprises using a plurality of intermediate mandrels in a rotation through the spinning machine, each successive intermediate mandrel being either loaded, spun in the spinning machine, being ejected, or the parts being ejected. The number of intermediate mandrels in rotation in the manufacturing process is then simply a function of the intermediate mandrel removal and ejection cycle time.

Although a form of the invention has been described herein, it will be obvious to those skilled in the art that variations may be made in the construction and relation of parts without departing from the spirit and scope of the invention described herein.

I claim:

1. A method of spinning multiple parts comprising:

attaching two blanks to an intermediate mandrel;

loading the intermediate mandrel and blanks into the spinning machine by clamping the intermediate mandrel and the blanks between a spinning machine tailstock and headstock;

moving rollers simultaneously radially inward and outward to execute metal forming on each blank to form a part from each blank;

ejecting the intermediate mandrel; and ejecting each part substantially simultaneously from the intermediate mandrel.

2. The method as in claim 1 further comprising pre-forming the blanks before attaching the blanks to an intermediate mandrel.

3. The method as in claim 1 further comprising ejecting the intermediate mandrel by simultaneous use of a headstock ejector and tailstock ejector.

4. The method as in claim 1 further comprising reloading the intermediate mandrel with two new blanks.

5. The method as in claim 1 further comprising using a plurality of intermediate mandrels in a rotation through the spinning machine.

6. The method as in claims 1 further comprising spinning parts using rollers having different surface profiles.

* * * * *